US006701661B2

(12) United States Patent
Murello

(10) Patent No.: US 6,701,661 B2
(45) Date of Patent: Mar. 9, 2004

(54) ADJUSTMENT DEVICE FOR A FIREARM SYSTEM

(75) Inventor: Johannes Murello, Deisslingen (DE)

(73) Assignee: Heckler & Koch GmbH, Oberndorf/Neckar (DE)

( * ) Notice: Subject to any disclaimer, the term of this patent is extended or adjusted under 35 U.S.C. 154(b) by 0 days.

(21) Appl. No.: 09/989,023

(22) Filed: Nov. 20, 2001

(65) Prior Publication Data

US 2002/0066361 A1 Jun. 6, 2002

Related U.S. Application Data

(63) Continuation of application No. PCT/EP00/04444, filed on May 16, 2000.

(30) Foreign Application Priority Data

May 21, 1999 (DE) ..... 199 23 474

(51) Int. Cl.[7] ..... F41G 1/033
(52) U.S. Cl. ..... 42/134; 89/41.16; 89/1.41
(58) Field of Search ..... 89/29, 41.06, 1.41, 89/41.16; 42/106, 134

(56) References Cited

U.S. PATENT DOCUMENTS

| | | | | |
|---|---|---|---|---|
| 2,860,015 A | | 11/1958 | Matterson | 308/62 |
| 3,098,410 A | * | 7/1963 | Giza | 42/111 |
| 3,228,299 A | * | 1/1966 | Grandy | 89/41.16 |
| 3,353,291 A | | 11/1967 | Musser | 42/1 |
| 3,550,300 A | * | 12/1970 | Roder | 42/106 |
| 4,273,026 A | * | 6/1981 | Walter | 89/37.01 |
| 4,872,390 A | | 10/1989 | Bertiller et al. | 89/29 |
| 5,034,170 A | * | 7/1991 | Briggs et al. | 264/1.25 |
| 5,127,820 A | * | 7/1992 | Briggs et al. | 249/144 |
| 5,181,323 A | * | 1/1993 | Cooper | 42/122 |
| 5,657,546 A | * | 8/1997 | Canaday | 42/111 |
| 5,771,595 A | * | 6/1998 | Bell | 42/122 |

FOREIGN PATENT DOCUMENTS

| | | | |
|---|---|---|---|
| DE | 31 08 988 A1 | | 9/1982 |
| DE | 3108988 | * | 9/1982 |
| EP | 0 309 707 A2 | | 5/1989 |
| GB | 1099663 | | 1/1968 |

OTHER PUBLICATIONS

Article entitled "*Heckler & Koch OICW– Weapon for the Next Millennium*" (published in German), in the "*Deutsche Waffen–Journal*" (DWJ) (German Weapons Journal), May 5, 1999, at p. 672 et seq., published by the firm Journal–Verlag Schwend GmbH.

*International Search Report*, corresponding to International Patent Application Ser. No. PCT/EP00/04444, European Patent Office, dated Sep. 29, 2000, 4 pages.

*International Preliminary Examination Report* with *Translation* corresponding to International Patent Application Ser. No. PCT/EP00/004444, dated Aug. 10, 2001, 5 pages.

* cited by examiner

*Primary Examiner*—Michael J. Carone
*Assistant Examiner*—Troy Chambers
(74) *Attorney, Agent, or Firm*—Marshall, Gerstein & Borun LLP

(57) ABSTRACT

A device for adjusting the relative positions of a first module and a second module on a firearm system includes an intermediate barrel adapted for mounting to the firearm system such that an axis of the intermediate barrel is fixed relative to the first module. A first adjusting cam is rotatably supported on the intermediate barrel and operatively engages the second module at an attachment point so as to displace the attachment point along a first adjustment line in response to rotation of the first adjusting cam. A second adjusting cam is rotatably supported on the intermediate barrel and is rotatable independently of the first adjusting cam. The second adjusting cam operatively engages the second module at the attachment point and is arranged to displace the attachment point along a second adjustment line in response to rotation of the second adjusting cam. The first and second adjustment lines are non-parallel to each other.

13 Claims, 4 Drawing Sheets

ADJUSTMENT DEVICE FOR A FIREARM SYSTEM

PRIORITY CLAIM

This application claims priority under 35 U.S.C. § 120 from PCT Application Serial No. PCT/EP00/04444, filed May 16, 2000.

FIELD OF THE INVENTION

The present invention relates generally to firearm systems and, more specifically, to a device for adjusting the mutual position of two modules on a firearm system.

BACKGROUND OF THE INVENTION

Throughout this document, the term "firearm system" comprises single- or multi-barreled firearms which can be additionally combined with an add-on device, such as an optical aiming device or even an additional firearm or barrel.

Further, the term "module", in particular, may be understood to refer to a barrel or an aiming device, or the longitudinal axes of the same, as the case may be. The term also may, however, refer to any other desired component of a firearm system or the axis of the same, as the case may be.

In orienting one axis relative to another one, such as the sighting line of a diopter relative to the bore axis of a corresponding barrel, it has long been customary to use two threaded spindles such as, for example, a horizontal spindle and a vertical spindle, in order to effectuate the elevational adjustment and the side-to-side adjustment independently of one another. Such screw spindle devices can, depending on a corresponding dimensioning, also absorb considerable forces, such as in the case of the elevation- and side-to-side directing device of a gun. Such a system has, however, the corresponding disadvantage of requiring considerable space.

In many applications, such as, for example, in the case of attachable barrels, sufficient space to accommodate screw spindle devices may not be available. Such an attachable barrel is, as a rule, used for a small-caliber bullet cartridge and is used in the shot barrel of a combined weapon, such as a triple-barreled shotgun. In that case, the attachable barrel must be adjusted in such a manner that its point of meeting is in agreement with the holding point of the sight of the weapon which is shot on the bullet barrel of the same.

In the preceding example, the rear portion of the attachable barrel is supported radially in a clearance-free manner but is easily swivelable in the cartridge storage of the shot storage, and a ring which is placed at a distance from the internal wall of the shot storage is positioned on the front part of the attachable barrel. This ring has four radial threaded borings over its circumference, each displaced by 90°. The axes of the borings are typically oriented along the horizontal or the vertical. Headless screws which must, upon the shooting of the weapon, be rotated outwardly or inwardly in such a manner that the external ends of the headless screws are solidly supported on the internal wall of the shot barrel if the barrel has reached the relative position desired, are positioned in the threaded borings. This disadvantageously brings about, however, a line contact between the ends of the screws and the internal wall of the shot barrel and, in addition, it only does so over a slight portion of the external circumference. It is advantageous, however, that the adjustment of the attachable barrel in accordance with elevation and side is carried out separately and is, accordingly, relatively simple.

In addition, it is already known, from the case of older attachable barrels, to carry out their adjustment by means of two eccentric rings. In addition, the external diameter of at least one ring had to be adjusted to the internal diameter of the smooth bore barrel, which could possibly be avoided by means of tight spring elements. Shooting, however, was particularly difficult, since an adjustment in accordance with elevation and side was not possible but had, instead, to be carried out simultaneously along a curved line. For this reason, such constructions have been abandoned for a long time. A firearm with an attachable barrel which can, by means of an eccentric bearing shell, be rotated and displaced in the longitudinal direction of the barrel relative to the barrel accommodating it, is known from the publication DE 31 08 988 A1.

An attachable firearm for incorporation into the weapon barrel of an armored war vehicle, the desired target direction of which can be adjusted by means of two axially non-displaceable eccentric casings proceeding within one another, is additionally known from the publication EP 0 309 707 A2. The problem noted above, that a separate elevational and side-to-side adjustment is not possible, but must instead be carried out through the superpositioning of curved lines, is also present in the teachings of the above-referenced EPO publication. A similar construction with three eccentric rings is known from the document U.S. Pat. No. 3,550,300 A.

Furthermore, a coaxial firearm, in which the adjustment is carried out by means of two toothed eccentric rings, is known from the publication U.S. Pat. No. 3,228,299 A.

In addition, the article entitled "Heckler & Koch OICW—Weapon for the Next Millennium" (published in German), in the "Deutsche Waffen-Journal" (DWJ) (German Weapons Journal), May 5, 1999, at page 672 et seq., published by the firm Journal-Verlag Schwend GmbH, describes a device for the adjustment of the mutual position of two barrels of a firearm system with two rotatable adjusting cams, through the rotation of which the meeting point positions are adjusted to one another.

Finally, a coaxial firearm, in which the gun barrel can be adjusted in two coordinates relative to the barrel of the gun, is known from U.S. Pat. No. 3,353,291 A. In the '291 reference, the separate adjustment of the barrels relative to one another is possible.

Another more conventional approach may would be to choose the modern construction of the attachable barrel adjustment with four headless screws and to enlarge the bearing surface of the external ends of the screws by means of a supplemental shoe unit or the like in order to thus achieve the desired solidity. The solidity can, if applicable, also be further increased by using several sets of screws positioned in sequence one after the other—by accepting, in any event, a distinctly increased expense for the adjustment.

BRIEF DESCRIPTION OF THE DRAWINGS

An adjustment device for a firearm system will now be illustrated in detail by means of one example of implementation. The schematic diagrams appended hereto depict the following.

DETAILED DESCRIPTION OF THE PREFERRED EMBODIMENTS

Figure 1A:
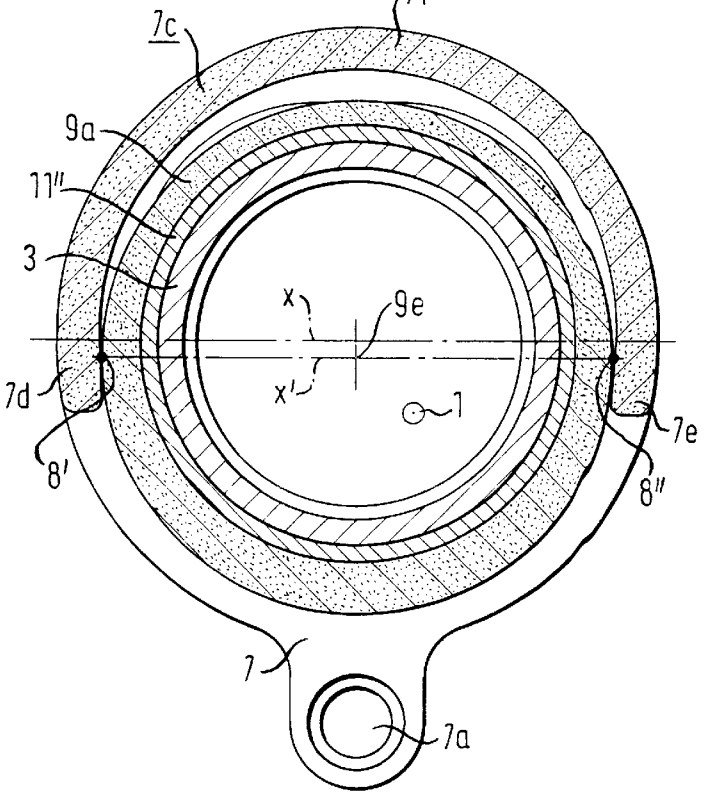
FIG. 1*a* is a cross-sectional view taken along line I—I of FIG. 1.

The following description of the disclosed exemplary embodiment is not intended to limit the scope of the invention to the precise form or forms detailed herein. Instead, the following description is intended to be illustrative of the principles of the invention so that others may follow its teachings.

The positional terms that are used in the following, such as "forward", "top", "left", etc., relate to a weapon positioned in an orderly manner upon the discharge of a horizontal shot, whereby the direction of the shot proceeds in the forward direction. The same is applicable to statements about direction ("to the front", "upwardly", "to the left", etc.).

Referring now to the drawings, FIGS. 1 through 4 depict a device for the adjustment of the mutual position of the bore axes of two barrels of a firearm, which is not depicted. The direction of shot of the firearm is indicated by an arrow 1. In the illustrated example, the firearm (not shown) may involve the combination of a large-caliber self-loading rifle and an expandable rapid-fire gun with a common discharge device, in which the two barrels should be able to be adjusted relative to one another. The one barrel—in this case, the barrel of the large-caliber self-loading rifle (not depicted)—is supported in a clearance-free manner, as would be known, inside of an intermediate barrel 3 which is solidly connected with the casing of the weapon in a known manner. The bore axis of the large-caliber barrel (not shown) is thereby solid with the casing and coincides, in the present example of implementation, with a longitudinal axis 3*a* of the intermediate barrel 3. At the same time, the support in the intermediate barrel 3 permits a longitudinal movement of this the large-caliber barrel during the shooting process in a known manner. Nevertheless, this large-caliber barrel is, for reasons of a better readability of the description, referred to in the following as a "stationary barrel" (stationary with respect to the fact that a longitudinal bore axis of the "stationary barrel" remains fixed or stationary with respect to the axis 3*a* of the intermediate barrel 3).

The position of the other barrel—here, the barrel of the modifiable rapid-fire gun (not depicted), or its bore axis, as the case may be—is fixed by two suspension points. Specifically, the barrel (and the bore axis of the barrel) of the modifiable rapid-fire gun (not shown) is supported in an easily swivelable manner on one of these suspension points in a known manner. This same barrel is also connected, on the other suspension point, with an eye 7*a* of a first adjusting element 7. The first adjusting element 7 is displaceable into and out of the plane of the diagram (viewing FIGS. 1 and 2), or stated another way, from side to side (when viewing FIG. 1*a*.). Further, the first adjusting element 7 is displaceable in elevation as well, and thus moves upwardly or downwardly, respectively. In this manner, the barrel of the modifiable rapid-fire gun can be swiveled around its one suspension point, and the angle of the two bore axes can consequently be adjusted relative to one another.

For the reasons stated, the barrel undergoing the adjustment will be referred to in the following as a "swivelable barrel". The horizontal and vertical displacement of the first adjusting element 7 thereby takes place separately, upon rotating a first adjusting cam 9 or a second adjusting cam 11, respectively. The adjustment is designed, in the present example of implementation, in such a manner that the first adjusting element 7 can be displaced into each of these directions (e.g., in the horizontal or vertical directions) proceeding from the middle position, by 1.5 mm. The adjustment process is additionally illustrated in still further detail below by means of FIGS. 1 and 2.

The first adjusting cam 9 is designed cylindrically and free of clearance, and can be rotated around the intermediate barrel 3 (and hence about the axis 3*a*) on a cylinder 11" of the second adjusting cam 11. The first adjusting cam 9 includes a circular eccentric ring 9*a* having a middle point 9*e* (i.e., an axis of eccentricity) that lies outside the rotational axis of the first adjusting cam 9 (see FIG. 1*a*, which shows the middle point 9*e* offset relative to the axis 3*a* of the intermediate barrel 3). Thus, the rotational axis of the first adjusting cam 9 coincides, in the present case, with the longitudinal axis 3*a* of the intermediate barrel 3.

The second adjusting cam 11 comprises a cylinder 11' and the cylinder 11", which are both supported on the intermediate barrel 3 in a clearance-free and rotatable manner. On the lower side of the intermediate barrel 3, both cylinders (11' and 11") engage with one another, such that the cylinders 11' and 11" will rotate together. The cylinders 11' and 11" are both rotatable about the bore axis of the stationary barrel (which is contiguous with the axis 3*a* of the intermediate barrel 3). The cylinder 11" has, on its rear end, a circular eccentric ring 11*a*. The eccentric ring 11*a* includes a middle point 11*e* (i.e., an axis of eccentricity) that lies outside the rotational axis of the second adjusting cam 11 (see FIG. 2*a*, which shows the middle point 11*e* offset relative to the axis 3*a* of the intermediate barrel 3).

The first adjusting element 7 is connected, by means of a first groove/spring connection 13 (see FIG. 4), with a second adjusting element 17. The first adjusting element 7 is thereby only displaceable relative to the second adjusting element 17 along a first adjustment line x (see FIG. 1*a*). The second adjusting element 17 is connected with the casing of the weapon by way of springs 23*a* and 23*b* (see FIG. 1) of a second groove/spring connection 23 in such a manner that the second adjusting element 17 is only displaceable along a second adjustment line y.

Figure 1:
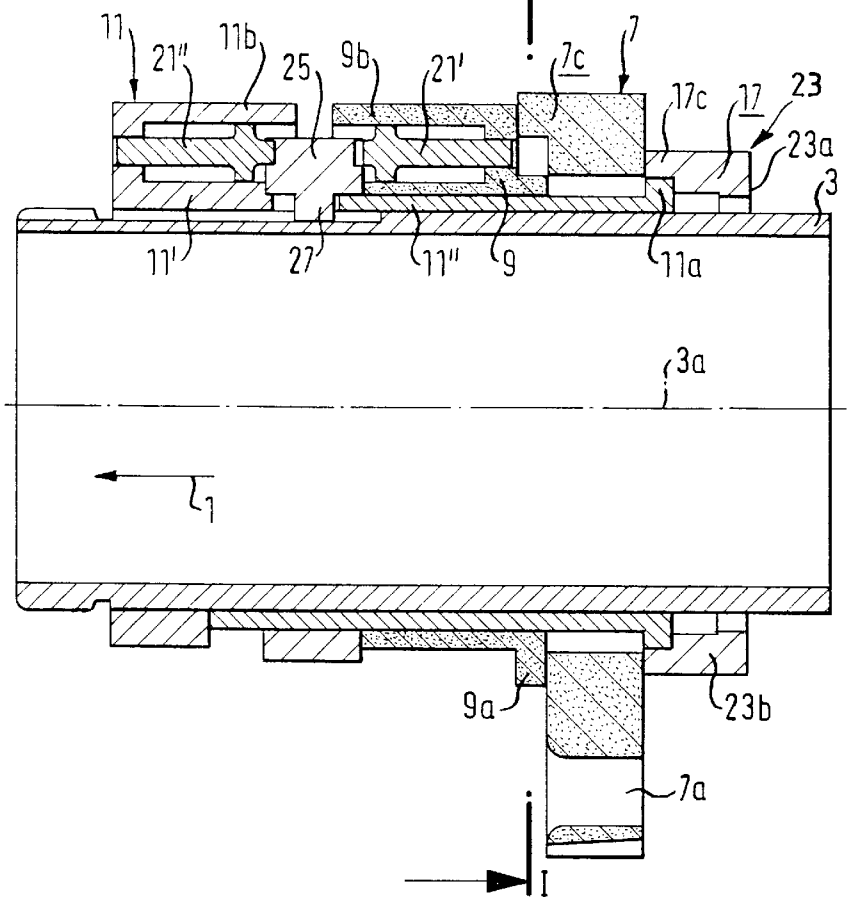
FIG. 1 is a sectional representation of the lateral view, taken from the left, of an adjustment device for a firearm system assembled in accordance with the teachings of the present invention, and wherein the horizontal adjustment process is represented by the gray shading of individual parts.

FIGS. 1 and 1*a* depict how the first adjusting element 7 can be displaced to the side—that is to say, along the first adjustment line (x)—by rotating the first adjusting cam 9. The working connection between the two parts—which are, for the purpose of viewing, shaded in gray—can be seen in FIG. 1*a*. The first adjusting element 7 includes a horseshoe-like shoulder 7*c*, which shoulder 7*c* includes a pair of oblong and generally parallel sections 7*d* and 7*e*. The sections 7*d* and 7*e* may be referred to as "corrugations." The eccentric ring 9*a* of the first adjusting cam 9 fits closely and in a clearance-free manner within the sections 7*d* and 7*e* of the shoulder 7*c*.

More specifically, as shown in FIG. 1*a*, the eccentric ring 9*a* engages the sections 7*d*, 7*e* at two lines that are referred to as contact points 8' and 8". The points 8' and 8" lie along a line of intersection x' that extends through the middle point 9*e* of the first adjusting cam 9. The line of intersection x' is oriented parallel to the line of adjustment x. Upon the rotation of the adjusting cam 9, the eccentric ring 9*a* carries out a crank-like movement (that is to say, simultaneously to the side and in elevation) around the rotational middle point of the adjusting cam 9 (which middle point lies contiguous with the axis 3*a*). The periphery of the eccentric ring 9*a* thereby maintains the clearance-free contact, at the contact points 8' and 8", with the first adjusting element 7. These contact points 8' and 8" lie at the level of the line x'. Since this line x' moves along with the middle point 9*e* of the eccentric ring 9*a*, the line x' can thereby come to lie congruently with the adjustment line x. The contact points 8' and 8" also will be correspondingly displaced in elevation. Otherwise, however, the eccentric ring 9*a* does not touch the first adjusting element 7 in its crank movement.

In this manner, the first adjusting element 7 is, upon the rotation of the first adjusting cam 9, only stressed along the adjustment line x—apart from any frictional forces possibly present, which appear during the circumferential movement from the sliding movement of the eccentric ring 9*a* on the contact points 8' and 8". The first adjusting element 7 is thereby displaced to the left or to the right, respectively (in relation to FIG. 1*a*, depending on whether the first adjusting cam 9 is rotated from its central starting position depicted in FIG. 1*a* in the clockwise or in the counterclockwise direction. It is ensured, by means of the groove/spring connection 13 with the second adjusting element 17, that the first adjusting element 7 does not thereby diverge from the adjustment line x.

If the first adjusting element 7 is displaced in height (by rotating the second adjusting cam 11), the corrugations 7*d* and 7*e* slide upwardly or downwardly relative to the eccentric ring 9*a*, but remain in clearance-free contact with the eccentric ring 9*a*. However, at the level of the line x', the position of the contact points 8' and 8" on the first adjusting element 7 may then be shifted downwardly or upwardly in a corresponding manner. The length of the corrugations 7*d* and 7*e* are preferably designed in such a manner that the eccentric ring 9*a* remains encompassed by the corrugations 7*d* and 7*e*, even upon the maximum displacement in height of the first adjusting element 7.

The shoulder 7*c* of the first adjusting element 7 also includes a semi-circular section 7*f*, which, as shown in FIG. 1*a*, extends downwardly to form the sections 7*d* and 7*e*. Because the eccentric ring 9*a* is supported, in the radial direction, on the corrugations 7*d* and 7*e*, the semi-circular section 7*f* of the shoulder 7*c* is not necessary for the displacement of the first adjusting element 7. Instead, the section 7*f* serves to provide support for the first adjusting element 7 on the first adjusting cam 9 in the axial direction (e.g., to the left and right when viewing FIG. 1).

Figure 2A:
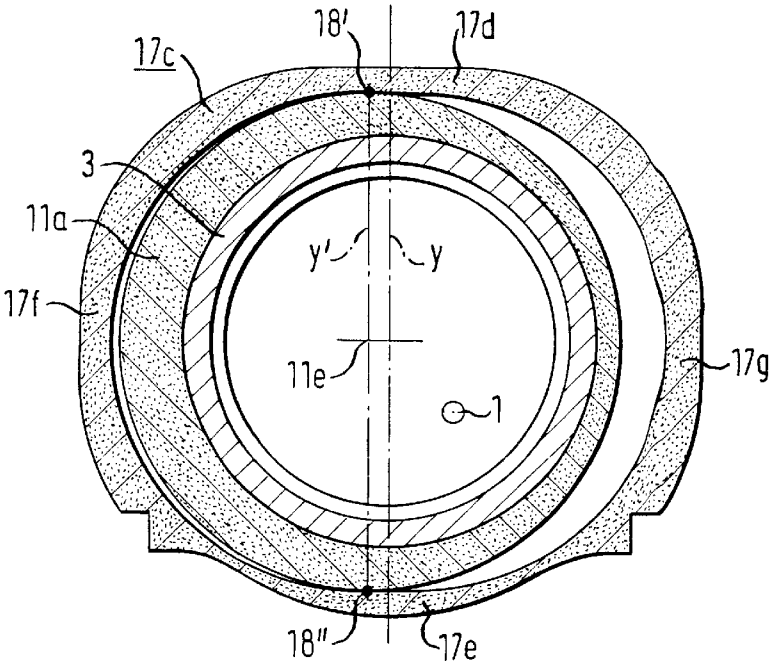
FIG. 2*a* is a cross-sectional view taken along line II—II of FIG. 2.
Figure 2:
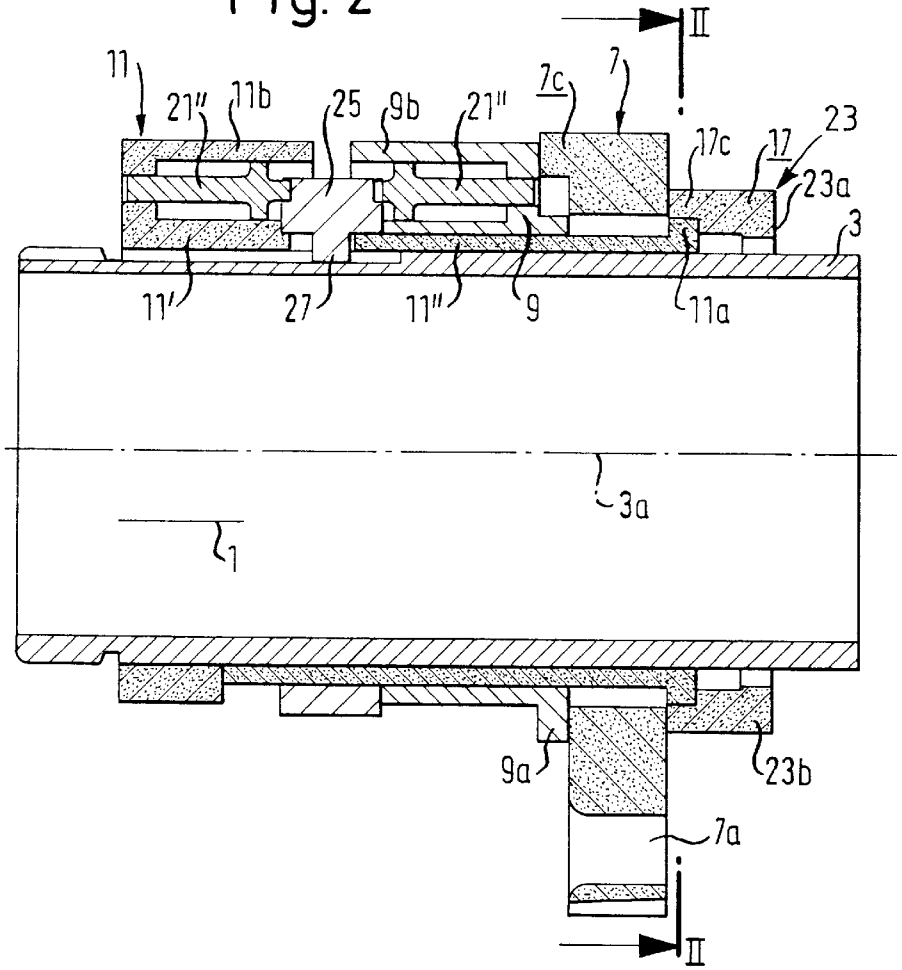
FIG. 2 is a cross-sectional view similar to FIG. 1 but in which the vertical adjustment process is represented by the gray shading of individual parts.
Figure 3:
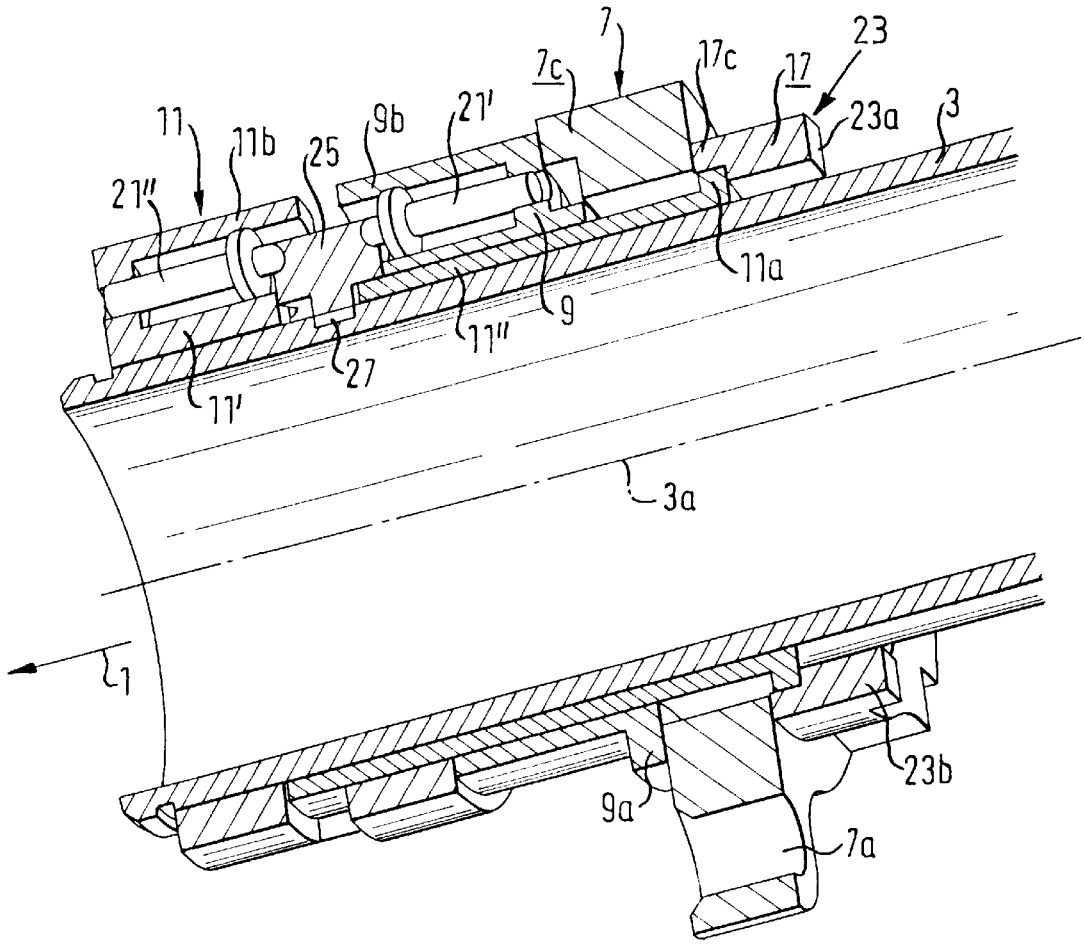
FIG. 3 is a fragmentary cross-sectional view in perspective of the cross-sections of FIGS. 1 and 2.

FIGS. 2 and 2 further represent the displacement of the first adjusting element 7 in its elevation, that is to say, along the second adjustment line y, through the rotation of the second adjusting cam 11. In FIGS. 2 and 2*a* the parts cooperating with this elevational adjustment are shaded in gray. The first adjusting element 7 is thereby displaced by means of the second adjusting element 17 which, in its turn, stands in a working connection with the eccentric ring 11*a* of the cylinder 11". The principle of operation that forms the basis for the working connection is essentially the same as that of the eccentric ring 9*a* and the first adjusting element 7. The second adjusting element 17 includes an oval shoulder 17*c* which extends downwardly to form a pair of corrugations or sections 17*f* and 17*g*. FIG. 2*a* shows that the eccentric ring 11*a* fits closely and in a clearance-free manner against the two corrugations 17*d* and 17*e* of the oval-shaped shoulder 17*c*, along two lines which are termed contact points 18' and 18". The contact points 18' and 18" are the intersecting points of the eccentric ring 11*a* with a line y' that is oriented in parallel to the second adjustment line y. The line y' moves along with the middle point 11*e* of the second eccentric ring 11*a*. Analogously to FIG. 1 or 1*a*, the eccentric ring 11*a* is, during its crank-like movement around the rotational middle point of the second adjusting cam 11 (which is contiguous with the axis 3*a*), the eccentric ring 11*a* is in contact with the second adjusting element 17 at the two contact points 18' and 18", so that the adjusting element 17 is thereby only stressed in the direction of the second adjustment line y.

The oval shoulder 17*c* extends downwardly to form a pair of semi-circularly shaped external sections 17*f* and 17*g*, which serve only for the support of the second adjusting element 17 in the axial direction (to the left and right when viewing FIG. 2). The direction of movement of the second adjusting element 17 is thereby guided by the second groove/spring connection 23. At the same time, the first groove/spring connection 13 brings about a joint displacement of the first adjusting element 7 with the second adjusting element 17.

The displacement of the first adjusting element 7 along the second adjustment line y (through the rotation of the second adjusting cam 11) therefore takes place directly by way of the second adjusting element 17. The displacement along the first adjustment line x (through the rotation of the first adjusting cam 9) is, however, a movement of the first adjusting element 7 relative to the second 17. The adjusting element 17 consequently functions as a type of cross slide. The adjustment lines (x and y) are thereby oriented orthogonally to one another. In this way, the position of the first adjusting element 7 or of the eyelet 7*a*, respectively, can be separately adjusted in accordance with elevation and side-to-side (horizontal) movement.

Figure 4:
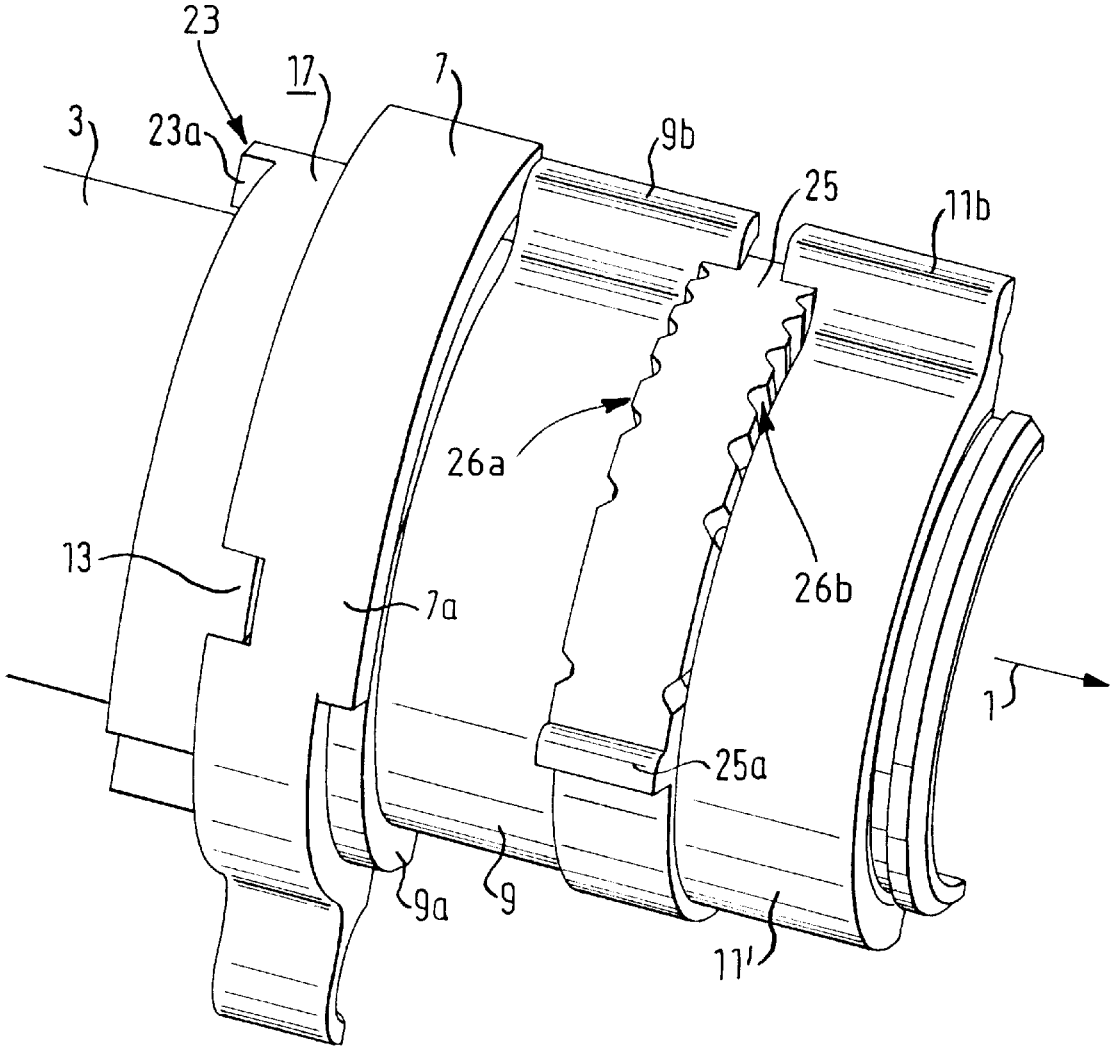
FIG. 4 is a fragmentary cross-sectional view in perspective taken from the opposite side of the weapon.

As best shown in FIG. 4, both of the adjusting cams 9 and 11 have a raised grip 9*b*, 11*b*, respectively, which fulfill a double function. On the one hand, the grips 9*b* and 11*b* serve as handgrips for the manual twisting of the adjusting cams 9 or 11. On the other hand, and as shown in FIGS. 1 and 2, the grips 9*b* 11*b* serve as support shells for the accommodation of stop bolts 21' or 21". The stop bolts 21' and 21" each include and end that faces a disk 25 located between the grips 9*b* and 11*b*. The disk 25 is rotationally fixed relative to the intermediate barrel 3. The stop bolts 21' and 21" each have an end which engages a first or second set of notches 26*a*, 26*b* on the disk 25. The stop bolts 21' and 21" thus support the adjusting cam 9 or 11, respectively, in the circumferential direction. The essentially ring-shaped engaging disk (25) is, by way of a groove/spring connection 27, connected with the intermediate barrel 3 and thereby supported in a non-rotating manner. The disk 25 also includes a first catching stud 25*a* (see FIG. 4) and, on the opposite side and at the same elevation, a second catching stud (not depicted), against which the grips 9*b* and 11*b* impact upon the corresponding twisting of the adjusting cams 9 or 11. The angle of rotation of the adjusting cams 9 and 11 may be restricted in this manner.

The stop bolts 21' and 21" are preferably spring-loaded in the direction of (i.e., towards) the engaging disk 25 so that, upon the rotation of the adjusting cams 9 or 11, respectively, the stop bolts 21' and 21" are automatically pressed into one of the corresponding sets 26*a*, 26*b* of notches in the engaging disk 25. Preferably, recessed notches may be slightly beveled on the sides, so that rotation of the adjusting cams 9 and 11 from position to another is possible without having to specially pull or retract the stop bolts 21' and 21" out of the recessed notches. The expenditure of force that is necessary to permit rotation of the cams 9 or 11 can be determined in accordance with the strength of the springs used to bias the stop bolts 21', 21", in such a manner that the adjusting cams 9 and 11, respectively are secured in their desired position against an undesired maladjustment. A moderate strength of spring may be sufficient for this purpose, because the forces that are exerted on the adjusting cams 9 and 11 during the shooting process by the swivelable barrel and the first adjusting element 7 are, because of the small lever arm, relatively small, which corresponds to the eccentricity of the eccentric rings 9*a* or 11*a*, respectively. The lever arm is clearly more favorable from the side of the cams 9*b* and 11*b*, so that a problem-free adjustment by hand is possible.

The adjustment positions of the adjusting cams 9 and 11 are accordingly set by the recessed notches 26*a*, 26*b* of the engaging disk 25. The recessed notches are thereby positioned in such a manner that the first adjusting element 7 is, upon the rotation of the adjusting cams 9 and 11, displaced from one engagement position of the stop bolts 21' or 21" in their corresponding notches 26*a*, 26*b*, to the next adjacent notches, by steps, each step being a known or constant value.

A device assembled in accordance with the disclosed example may offer certain advantages. These advantages may include the ability to absorb relatively high forces, along with low space requirements. Through an axial extension of the contact surfaces between the two eccentric rings 9*a*, 11*a*, and the adjusting elements 7 or 11, respectively, the capacity to absorb forces may be enhanced without the requirement for additional space. By means of a corresponding dimensioning of the device, it is also easily possible to adjust still heavier or more heavily stressed modules, as the case may be, to one another than the ones stated here by way of example, and to secure them in their position.

One additional advantage lies in the possibility of adjusting the second module—that is to say, the bore axis of the swivelable barrel—alone, by means of the first adjusting element 7 (or the eyelet 7*a*, respectively), and thus by way of a single suspension point. This is brought about by means of the cross slide-like support of the first adjusting element 7. A very compact manner of construction, which contributes to the stated space advantages, additionally results from that.

Furthermore, and in distinction to the conventional solutions with screw spindles, a relatively precise adjustability of the modules can be provided. This is brought about by means of a correspondingly precise fitting between the eccentric rings 9*a* and 11*a*, and the corrugations 7*d*, 7*e*, or 17*d*, 17*e*, respectively.

Finally, the adjustment can be carried out in the present arrangement directly by hand. No mounting step or tool is, therefore, necessary. In addition, the adjusting cams or grips 9*b*, 11*b* are additionally positioned directly next to one another, so that the device only needs to be accessible from the outside at one point. The advantages of a simple handling, as well as a separate adjustment in accordance with elevation and side, which are already known from the state of the art, are consequently maintained.

In further accordance with the disclosed example, a rotatable eccentric adjustment is employed which makes possible a linear displacement of at least one module or of an element to engage with the same by means of an adjustment element. A swiveling of the module can then be carried out easily, since the module is suspended on a first support point in a swivelable manner and is displaced, on a second support point, by an attachment point which moves in response to rotation of the eccentric element. Such a device for the adjustment of the mutual position of at least a first and a second module of a firearm system may have the following characteristics: At least one first rotatable adjusting cam stands in a working connection with at least the first module in such a manner that, by rotating this adjusting cam, the first module can be displaced relative to the second module along a first adjustment line or within a first adjustment plane. The displacement or swiveling of the first module along the first adjusting line or inside the first adjustment plane, respectively, is carried out by means of at least a first adjusting element which is in operative connection with the first module and the first adjusting cam in such a manner that, by rotating the first adjusting cam, the first adjusting element can be displaced along the first adjusting line. A second adjusting cam, which is rotatable independently of the first adjusting cam, likewise stands in a working connection with at least the first module in such a manner that, by rotating the second adjusting cam, the first module is displaceable relative to the second module along a second adjusting line, or is swivelable inside a second adjusting plane, whereby the two adjusting lines or adjusting planes, respectively, are not parallel to one another. The displacement or swiveling, respectively, of the first module along the second adjusting line or inside the second adjusting plane, respectively, thereby also takes place by means of the first adjusting element which, for this purpose, also stands in a working connection with the second adjusting cam in such a manner that, by rotating the second adjusting cam, the first adjusting cam is displaceable along the second adjusting line.

In further accordance with the disclosed embodiment, an adjustment device is created that permits separate adjustment of the relative positions of two modules, such as two barrels or a barrel and a sighting device. The disclosed device for carrying out the goals stated above, will permit an effortless separate adjustment in accordance with the side and elevation, while at the same time occupying only a relatively minimal amount of space.

It will be understood that the term "adjusting cam" may include a number of different types of bodies. The external shape of such bodies are preferably designed to stress or move a module or adjusting element, as the case may be, upon the rotation of the body. the body is preferably fitted closely to the adjusting element, in the direction of the specific adjustment lines or adjustment planes, as the case may be. For this purpose, a protuberance, cam or grip, for example, can be attached to the external side of the adjusting cam.

The two different modules can be adjusted relative to one another. For example, a back sight, a front sight, or a telescopic sight may be adjusted relative to a barrel. Further one barrel may be adjusted relative to another barrel (or the longitudinal or bore axes of the same, as the case may be). Through the combination of correspondingly numerous adjustment devices in accordance with the disclosed embodiment, more than two modules can also be adjusted relative to one another. Thus, the bore axes of several barrels of a firearm can be adjusted relative to one another or relative to an additional axis, such as the sighting line of a telescopic sight, for example.

It emerges from what has been stated above that the adjusting element, at least in the functional respect, may be positioned between the first module and the first adjusting cam. The adjusting element can thereby be connected with the module in a substance-based self-locking manner, and thus form one unit with the same.

Further, the two adjustment lines or adjustment planes, as the case may be, are preferably oriented orthogonally to one another. In this manner, the modules can be separately adjusted in accordance with either elevational or side-to-side adjustment, that is to say, through the rotation of the first or second adjusting cam, as the case may be (or vice versa).

Through the fact that the first adjusting element 7 also stands in a working connection with the second adjusting cam 11, the displacement or swiveling, as the case may be, of the first module is carried out along both of the adjustment lines x and y or within both of the adjustment planes, as the case may be, solely by means of the first adjusting element 7. The displacement or swiveling, as the case may be, of the first module can therefore be brought about by means of a single support point and, specifically so, at the point where the first module stands in a working connection with the first adjusting element 7. Here, too, it is also conceivable to design the module and the adjusting element 7 as one unit.

A second adjusting element may be provided, by means of which the displacement of the first adjusting element takes place along the second adjustment line. The second adjusting element thereby stands in a working connection with the second adjusting cam and the first adjusting element in such a manner that, through the rotation of the second adjusting cam, the second adjusting element can be further displaced along the second adjustment line, and thereby also acts to displace the first adjusting element in the same direction. The displacement of the first adjusting element along the first adjustment line is again carried out by means of the first adjusting cam and, specifically so, independently of the second adjusting element.

The adjusting cams are preferably designed as cam disks or eccentric disks. Such a cam disk may take the form of any disk-like or ring-like body with an external contour proceeding in a curved manner, with the external eccentric contour varying from the central rotational point of the body.

The first and/or the second adjusting cam may be designed as an eccentrically supported cam disk. The corresponding adjusting elements are then preferably so designed and positioned such that they each fit closely, permanently and in a clearance-free manner, on precisely two contact points on the external side of the first or of the second circular disk, as the case may be, whereby the contact points are the imaginary intersecting points of the specific circular disk with a first or second line, as the case may be, which proceeds through the middle point of the cam disk and is oriented in parallel to the first or the second adjustment lines, as the case may be. The term "permanent" here means that, upon the rotating of the specifically corresponding circular disk, the adjusting elements continuously remain in contact with this. The term "precisely two contact points" means that this contact only exists on these points, so that the adjusting elements are, therefore, spaced on the remaining circumference of the circular disk. In this way, through the movement of the circular disks—that is to say, through the rotation of the adjusting cam—, the corresponding adjusting element is only stressed in the direction of its adjustment lines.

The first and/or second adjusting cams may be supported on an axis positioned stationary relative to the casing of the weapon. This axis can be the longitudinal axis of the first module, such as the bore axis of a barrel rigidly connected with the casing of the weapon, for example.

Under certain circumstances, it can be advantageous if at least one of the two adjusting cams consists of two or more individual parts that can be detachably connected with one another. This is for reasons of mounting, for example, if an adjusting cam is extended in the axial direction and thereby engages with other components positioned on this axis.

The adjusting elements, are preferably forcibly guided along their specific adjustment lines by means of first or second guiding means. In this manner, in the event of need, such as in the case of an insufficient guiding by the adjusting cam, for example, the displacement devices of the adjusting elements can be set in a clamping manner. The guiding means are thereby preferably designed as a part of the movable arrangement of the adjusting elements.

The first guiding means of the first adjusting element may be rigidly connected with the second adjusting element. A displacement of the first adjusting element relative to the second adjusting element is thereby only possible along the first adjustment line. This also has the result that the first adjusting element is, upon the displacement of the second adjusting element, also displaced with this along the second adjustment line. The second adjusting element is also preferably guided in a clamping manner and, specifically so, by means of second guiding means which are connected with the casing of the weapon in a rigid manner.

Essentially, every type of working connection that is suitable for prescribing the direction of movement and/or the position of the adjusting elements upon their displacement comes into consideration as guiding means. As an example, the first or second guiding means may be designed as a groove/spring connection. The groove/spring connection can thereby be designed as a dovetail, for example, in order to also anchor the specific adjusting element in the axial direction.

The adjusting cams may be secured in their position by means of locking devices. In this manner, an undesired misadjustment of the modules or adjusting elements, as the case may be, particularly by the forces that appear during the shooting process, is prevented. The locking means can be designed in different ways, depending on the space requirements and the forces to be absorbed. One simple possibility is force-locking securing devices, such as a spring steel disk which stresses the adjusting cam in the axial direction. One additional example is a clamping connection, by means of which the adjusting cams are tightly held in their adjusted position. Form-locking connections additionally come into consideration as locking means.

The locking means may comprise an engaging disk and at least one stop bolt for each adjusting cam. The stop bolt(s) stand in a working connection with the specific adjusting cam and engages with fitting recesses or notches of an engaging disk, which engaging disk is non-rotating or fixed to the casing. Different adjustment positions can thus be set through the suitable arrangement of several recesses or notches. The stop bolts are preferably spring-loaded, so that they automatically engage with the recesses. The connection between the stop bolt and the engaging disk can then be designed in such a manner that the stop bolt must, for the further adjustment of the specific adjusting cam, be manually drawn out of the recess or, in the event of a sufficiently high rotational force, yield by itself. The latter possibility simplifies the adjustment process, but sets as a presupposition for a locking of the adjusting cam, however, that the strength of the spring is adjusted to the forces appearing on the side of the weapon. It is additionally possible for at least one adjusting cam to engage directly with the engaging disk, such as by means of a solidly-attached stop bolt or a suitable toothing. The axial locking of the adjusting cam, such as a locking ring, for example, must then be removed manually for adjustment.

Finally, through the rotation of the adjusting cam from one adjustment position to the next, the first or second adjusting element, as the case may be, can be displaced along their adjustment lines x, y, each at the same distance. Both of the modules can thereby be displaced or swiveled against one another by constant steps, as the result of which the adjustment process is considerably facilitated.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. For use with a firearm system having a first module and a second module, a device for adjusting the relative positions of the first module and the second module, the device comprising:

an intermediate barrel, the intermediate barrel adapted for mounting to the firearm system such that an axis of the intermediate barrel is fixed relative to the first module;

a first adjusting cam rotatably supported on the intermediate barrel, the first adjusting cam operatively engaging an attachment point, the attachment point adapted to engage the second module, the first adjusting cam arranged to displace the attachment point along a first adjustment line in response to rotation of the first adjusting cam;

a second adjusting cam rotatably supported on the intermediate barrel, the second adjusting cam rotatable independently of the first adjusting cam, the second adjusting cam operatively engaging the second module at the attachment point, the second adjusting cam arranged to displace the attachment point along a second adjustment line in response to rotation of the second adjusting cam, the first and second adjustment lines non-parallel to each other; and a fixed ring secured about the intermediate barrel and having two sets of notches oriented adjacent an outer circumference of the fixed ring, the first adjusting cam including a retractable lock bolt sized to engage a selected one of the first set of notches, the second adjusting cam including a retractable lock bolt sized to engage a selected one of the second set of notches, each of the first and second lock bolts reciprocating in a direction parallel to a longitudinal axis of the intermediate barrel.

2. The device of claim 1, wherein the attachment point is carried by an adjusting element, the adjusting element shiftably mounted on the intermediate barrel for horizontal and vertical movement along the first and second adjustment lines, respectively, the first adjusting cam arranged to shift the adjusting element along the first adjustment line in response to rotation of the first adjusting cam, the second adjusting cam arranged to shift the adjusting element along the second adjustment line in response to rotation of the second adjusting cam, and wherein adjusting element includes a groove connection oriented alone at least one of the first and second adjustment lines.

3. The device of claim 1, including a second adjusting element operatively connected to and responsive to the rotation of the second adjusting cam, the first adjusting element moveable relative to the second adjusting element along the second adjustment line in response to rotation of the second adjusting cam.

4. The device of claim 1, wherein the first adjusting cam and the second adjusting cam each comprise an eccentric disk.

5. The device of claim 1, wherein at least one of the first adjusting cam and the second adjusting cam comprises an eccentrically-supported cam disk.

6. The device of claim 1, wherein the first and second adjustment lines are orthogonal.

7. The device of claim 1, wherein the first and second adjusting cams are rotatable about the axis of the intermediate barrel, the first adjusting cam including an eccentric portion rotatable about a first midpoint, the second adjusting cam including an eccentric portion rotatable about a second midpoint, the first and second midpoints offset from the axis of the intermediate barrel.

8. The device of claim 1, including first guide means for guiding the first adjusting element along the first adjustment line, and including second guide means for guiding the second adjusting element along the second adjustment line.

9. The device of claim 8, wherein the second guide means is adapted for rigid connection to the firearm system.

10. The device of claim 8, wherein at least one of the first and second guide means comprises a tab.

11. The device of claim 1, wherein each of the first and second adjusting cams includes means for locking the first and second adjusting cams in a desired position.

12. The device of claim 1, wherein the notches of the first set and the notches of the second set are spaced apart on the fixed ring so that upon rotation of the first adjusting cam and the second adjusting cam from a first notch to a second notch, the first and the second adjusting elements, respectively, are displaced along the first and second adjustment lines, respectively, the same distance.

13. The device of claim 1, the first adjusting cam includes an eccentric axis offset from a rotational axis of the first adjusting cam, and the second adjusting cam includes an eccentric axis offset from a rotational axis of the second adjusting cam.

* * * * *

UNITED STATES PATENT AND TRADEMARK OFFICE

CERTIFICATE OF CORRECTION

PATENT NO. : 6,701,661 B2
DATED : March 9, 2004
INVENTOR(S) : Johannes Murello

It is certified that error appears in the above-identified patent and that said Letters Patent is hereby corrected as shown below:

Column 12,
Line 6, delete “wherein adjusting” and insert instead -- wherein the adjusting --.
Line 7, delete “alone” and insert instead -- along --.

Signed and Sealed this

Sixteenth Day of November, 2004

JON W. DUDAS
*Director of the United States Patent and Trademark Office*